US009133531B2

(12) United States Patent
Reese et al.

(10) Patent No.: US 9,133,531 B2
(45) Date of Patent: Sep. 15, 2015

(54) HIGH ENERGY TREATMENT OF CUTTER SUBSTRATES HAVING A WEAR RESISTANT LAYER

(75) Inventors: Michael R. Reese, Houston, TX (US); Kelly O. Malone, Houston, TX (US)

(73) Assignee: VAREL INTERNATIONAL IND., L.P., Carrollton, TX (US)

( * ) Notice: Subject to any disclaimer, the term of this patent is extended or adjusted under 35 U.S.C. 154(b) by 402 days.

(21) Appl. No.: 13/560,868

(22) Filed: Jul. 27, 2012

(65) Prior Publication Data

US 2012/0285101 A1 Nov. 15, 2012

Related U.S. Application Data

(62) Division of application No. 12/555,947, filed on Sep. 9, 2009, now Pat. No. 8,252,226.

(60) Provisional application No. 61/098,350, filed on Sep. 19, 2008.

(51) Int. Cl.
*B22F 3/24* (2006.01)
*C21D 7/06* (2006.01)

(52) U.S. Cl.
CPC ... *C21D 7/06* (2013.01); *B22F 3/24* (2013.01); *B22F 2003/247* (2013.01); *C21D 2221/00* (2013.01); *Y10T 428/24942* (2015.01); *Y10T 428/24983* (2015.01); *Y10T 428/30* (2015.01); *Y10T 428/31678* (2015.04)

(58) Field of Classification Search
USPC ..... 51/309; 75/240
See application file for complete search history.

(56) References Cited

U.S. PATENT DOCUMENTS 5,370,195 A * 12/1994 Keshavan et al. ..... 175/420.2
5,587,532 A 12/1996 Rose
5,631,423 A 5/1997 Rhodes
6,041,020 A 3/2000 Caron et al.
6,349,595 B1 2/2002 Civolani et al.

(Continued)

FOREIGN PATENT DOCUMENTS

WO 0125597 4/2001

OTHER PUBLICATIONS

Cotell et al, ASM Handbook, vol. 5 Surface Engineering, 1994, ASM International, pp. 118-125.*

(Continued)

*Primary Examiner* — Michael Cleveland
*Assistant Examiner* — Francisco Tschen
(74) *Attorney, Agent, or Firm* — King & Spalding LLP

(57) ABSTRACT

A high-energy treated cutter comprising a substrate having a top surface, an outer region, and an inner core and a wear resistant layer coupled to the top surface. The high-energy treatment alters the substrate's physical properties so that the inner core provides greater toughness and the outer region provides greater hardness, and greater abrasion resistance. The layer is protected prior to commencement of the treatment. In one embodiment, a cover is positioned to surround the layer and then the cutter undergoes treatment, wherein the cutter is subjected to impact forces with other cutters. In another embodiment, the cutter is positioned within a recess formed in a tray table, thereby providing protection to the layer. The cutter is secured in place via vacuum, glue, or weight. A spray nozzle applies shot material directed to the substrate of the cutter, thereby applying the impact forces to alter the substrate's properties.

16 Claims, 7 Drawing Sheets

(56) References Cited

U.S. PATENT DOCUMENTS

| | | | | |
|---|---|---|---|---|
| 7,258,833 | B2 | 8/2007 | Rainey et al. | |
| 7,558,369 | B1 | 7/2009 | Mourik et al. | |
| 2002/0124688 | A1* | 9/2002 | Liang | 75/240 |
| 2005/0053511 | A1* | 3/2005 | Rainey et al. | 419/18 |

OTHER PUBLICATIONS

Kazuhisa Miyoshi, Structures and Mechanical Properties of Natural and Synthetic Diamonds, Lewis Research Center, Ohio, NASA TM-1998-107249, Chapter 8, pp. 1-26, Jun. 1998.

M.K. Keshavan, M.A. Siracki, and M.E. Russell, Smith International Inc., Diamond-Enhanced Insert: New Compositions and Shapes for Drilling Soft-to-Hard Formations, Society of Petroleum Engineers/International Association of Drilling Contractors, SPE/IADC 25737, pp. 577-591, Feb. 1993.

R.L. Mehan and L.E. Hibbs, Thermal Degradation of Sintered Diamond Compacts, General Electric Research and Development Center, General Electric Company, New York, Journal of Materials Science 24, pp. 942-950, 1989.

M.H.B Nasseri, B.Schebnel A. Thompson, and R. P. Young, Acoustic Emission Monitoring Of Mode I Fracture Toughness (CCNBD) Test In Lac du Bonnet Granite, ARMA, American Rock Mechanics Association, Jun. 2005, Anchorage, Alaska.

* cited by examiner

HIGH ENERGY TREATMENT OF CUTTER SUBSTRATES HAVING A WEAR RESISTANT LAYER

CROSS REFERENCE TO RELATED APPLICATIONS

This patent application is a divisional of and claims priority under U.S.C. §120 to U.S. patent application Ser. No. 12/555,947 now U.S. Pat. No. 8,252,226, entitled "High Energy Treatment of Cutter Substrates Having a Wear Resistant Layer," filed Sep. 9, 2009; which claims priority under 35 U.S.C. §119 to U.S. Provisional Patent Application No. 61/098,350, entitled "High Energy Treatment of Cutter Substrates Having a Wear Resistant Layer," filed Sep. 19, 2008, the entirety of both being incorporated by reference herein.

The present application is related to U.S. Pat. No. 7,258,833, entitled "High-Energy Cascading Of Abrasive Wear Components" and issued on Aug. 21, 2007, which is assigned to the assignee of the present non-provisional patent application. U.S. Pat. No. 7,258,833 is incorporated by reference in its entirety herein.

BACKGROUND OF THE INVENTION

This invention relates generally to abrasive wear components and, more particularly, to high energy treated polycrystalline diamond compact ("PDC"), cubic boron nitride ("CBN") cutter, and other similar type cutter substrates and the methods of manufacturing such items.

Typically, down hole tools including, but not limited to drill bits and reamers, have a plurality of blades that have a plurality of cutters or inserts coupled to each of the blades. These plurality of cutters may include, but is not limited to, tungsten carbide inserts, PDC cutters, CBN cutters, and thermally stable polycrystalline diamond cutters. PDC cutters are fabricated by pressing a diamond layer onto a tungsten carbide substrate, or similar substrate, to create a highly wear resistant layer or cutter face. Similarly, CBN cutters are fabricated in the same manner except that a CBN layer is pressed in lieu of a diamond layer.

The substrate is typically formed by combining grains of a metallic material, such as tungsten carbide, with a binder material, such as cobalt, to form a composite material. This composite material is pressed into a desired shape and heated, sometimes under pressure, such that the binder material liquefies and cements the grains of abrasive material together. The cemented abrasive component is then allowed to cool and ground into shape to form the substrate. Higher concentrations of cobalt increases the toughness, but decreases the hardness or abrasion resistance.

As the down hole tool is rotated, the cutters scrape against the bottom and sides of the borehole to cut away rock. As the rate of penetration of the down hole tool increases, the effective life of these cutters is substantially decreased because the cutters become cracked and occasionally are violently torn from the blade. Thus, there is a need for fabricating cutters with greater hardness and toughness traits so that their effective life may increase.

With respect to tungsten carbide inserts, High Energy Tumbling, as disclosed in U.S. Pat. No. 7,258,833 (the "'833 Patent") issued to Rainey et al. on Aug. 21, 2007, has been used successfully to treat the tungsten carbide inserts in a way that work hardens the outer surface of the inserts while maintaining the core toughness of the inserts. This treatment creates inserts that are more resistant to both fracture breakage and to abrasive wear than untreated inserts. This process also acts to screen out inserts with significant but indiscernible flaws that would otherwise be used and fail prematurely.

With respect to PDC cutters, CBN cutters, and other similar type cutters, these cutters fail through breakage of the substrate at a rate estimated to be about 4% to about 8% of the time. Thus, PDC cutters, CBN cutters, and other similar type cutters having a highly wear resistant cutter face also may benefit from a surface treatment of the substrate equivalent to the High Energy Tumbling process to reduce the failure rate from substrate breakage suffered when in use. However, since the diamond layer of PDC cutters and the CBN layer of CBN cutters are extremely brittle, the High Energy Tumbling process would damage the layer thereby destroying the usefulness of the cutters, especially in drilling applications. Thus, the High Energy Tumbling process does not provide an effective method for treating PDC cutters, CBN cutters, and other similar type cutters when the entire fabricated cutter with the wear resistant layer is subjected to the process.

Additionally, treating the substrates in the High Energy Tumbling process prior to pressing the diamond layer or CBN layer is not a viable option because the benefits of the treatment would be substantially reversed during the High Pressure High Temperature press that is typically used to press the wear resistant layer to the substrate. Thus, the High Energy Tumbling process does not provide an effective method for treating the substrates of PDC cutters, CBN cutters, and other similar type cutters prior to pressing the diamond layer or CBN layer.

In view of the foregoing discussion, need is apparent in the art for improving the PDC cutters and the CBN cutters so that the life of the cutters are increased. Additionally, a need is apparent for providing effective surface treatment of the substrates for PDC cutters, CBN cutters, and other similar type cutters similar to that accomplished by the High Energy Tumbling process for tungsten carbide inserts, but accomplished in such a manner that the brittle diamond layer of the PDC cutter and the CBN layer of the CBN cutter are not damaged by the process. A technology addressing one or more such needs, or some other related shortcoming in the field, would benefit down hole drilling, for example creating boreholes more effectively and more profitably. This technology is included within the current invention.

BRIEF DESCRIPTION OF THE DRAWINGS

The foregoing and other features and aspects of the invention will be best understood with reference to the following description of certain exemplary embodiments of the invention, when read in conjunction with the accompanying drawings, wherein.

DETAILED DESCRIPTION OF THE INVENTION

Figure 1:
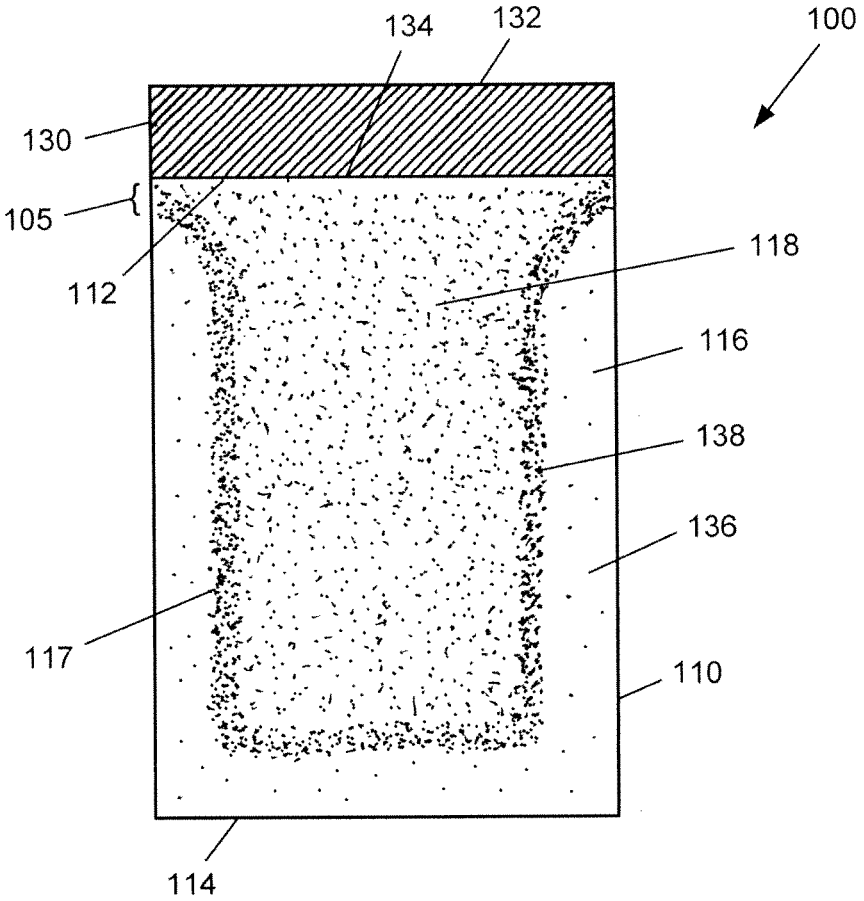
FIG. 1 shows a side cross-sectional view of a high energy treated cutter having a substrate and a wear resistant layer coupled to the substrate in accordance with an exemplary embodiment.

FIG. 1 shows a side cross-sectional view of a high energy treated cutter 100 having a substrate 110 and a wear resistant layer 130 coupled to the substrate 110 in accordance with an exemplary embodiment. The substrate 110 has a top surface 112, a bottom surface 114, an outer region 116, an inner core 118, and an interface 117 located between the outer region 116 and the inner core 118. The wear resistant layer 130 has a cutting surface 132 and an opposing surface 134, wherein the opposing surface 134 is coupled to the top surface 112 of the substrate 110. Typically, the wear resistant layer 130 is coupled to the substrate 110 using a high temperature high pressure press. However, other methods known by persons of ordinary skill in the art may be used to couple the wear resistant layer 130 to the substrate 110. In one embodiment, upon coupling the wear resistant layer 130 to the substrate 110, the cutting surface 132 of the wear resistant layer 130 is substantially parallel to the bottom surface 114 of the substrate 110. Additionally, the high energy treated cutter 100 has been illustrated as having a right circular cylindrical shape. Although the high energy treated cutter 100 is shown to have a right circular cylindrical shape, the high energy treated cutter 100 may be fabricated to have any other geometric shape without departing from the scope and spirit of the exemplary embodiment.

The substrate 110 is fabricated from a composite material that is typically formed from a mixture of a metallic material 136, such as tungsten carbide, and a binder material 138, such as cobalt. The metallic material 136 and the binder material 138 have been pressed together, thereby liquefying the binder material 138 and cementing the grains of the metallic material 136 together. Prior to applying a treatment on the substrate 110, which may be a high energy treatment, the composite material typically has the binder material 138 uniformly dispersed throughout the metallic material 136.

Upon applying the treatment to the substrate 110, the cutter is transformed into the high energy treated cutter 100, which is shown in FIG. 1. The outer region 116 has a lower concentration of binder material 138, while the inner core 118 has a higher concentration of binder material 138. It may also be seen that the interface 117 has the highest concentration of binder material 138. A higher concentration of cobalt increases the toughness and the impact resistance, but decreases the hardness, or abrasion resistance. Consequently, a lower concentration of cobalt increases the hardness, but decreases the toughness. Thus, the outer region 116 has greater hardness, or abrasion resistance, than the inner core 118 and the interface 117. Additionally, the inner core 118 has a greater toughness and impact resistance than the outer region 116. Moreover, the interface 117 has the greatest toughness. This configuration allows the high energy treated cutter 100 to have a greater longevity while in operation when compared to cutters that have the binder material 138 uniformly distributed within the substrate 110. Although tungsten carbide may be used as the metallic material 136, other materials known to persons having ordinary skill in the art may be used as the metallic material 136 without departing from the scope and spirit of the exemplary embodiment. Although cobalt may be used as the binder material 138, other materials including, but not limited to nickel, iron alloys, and/or combinations of the above, may be used as the binder material 138 without departing from the scope and spirit of the exemplary embodiment.

In the embodiment shown in FIG. 1, the interface 117 extends to the outer perimeter of the substrate 110 at a predetermined distance 105 away from the top surface 112 and towards the bottom surface 114 of the substrate 110. The pre-determined distance 105 may be greater than zero inches but less than or equal to 25 thousandths of an inch, greater than zero inches but less than or equal to 50 thousandths of an inch, or greater than zero inches but less than or equal to 100 thousandths of an inch. In other embodiments, the predetermined distance 105 may be greater than 100 thousandths of an inch without departing from the scope and spirit of the exemplary embodiment. Additionally, according to other embodiments, the predetermined distance 105 may be zero inches without departing from the scope and spirit of the exemplary embodiment. According to the embodiment shown in FIG. 1, the predetermined distance 105 is greater than zero inches. Thus, in this embodiment, a small portion of the substrate 110 that is immediately adjacent to the wear resistant layer 130 retains its higher toughness and impact resistance traits so that more support is provided immediately adjacent the wear resistant layer 130.

The wear resistant layer 130 is made from hard cutting elements, such as natural or synthetic diamonds. The cutters made from synthetic diamonds are generally known as polycrystalline diamond compact cutters (PDCs). Other materials, including, but not limited to, cubic boron nitride (CBN) and thermally stable polycrystalline diamond (TSP), may be used for the wear resistant layer 130 without departing from the scope and spirit of the exemplary embodiment.

Figure 2:
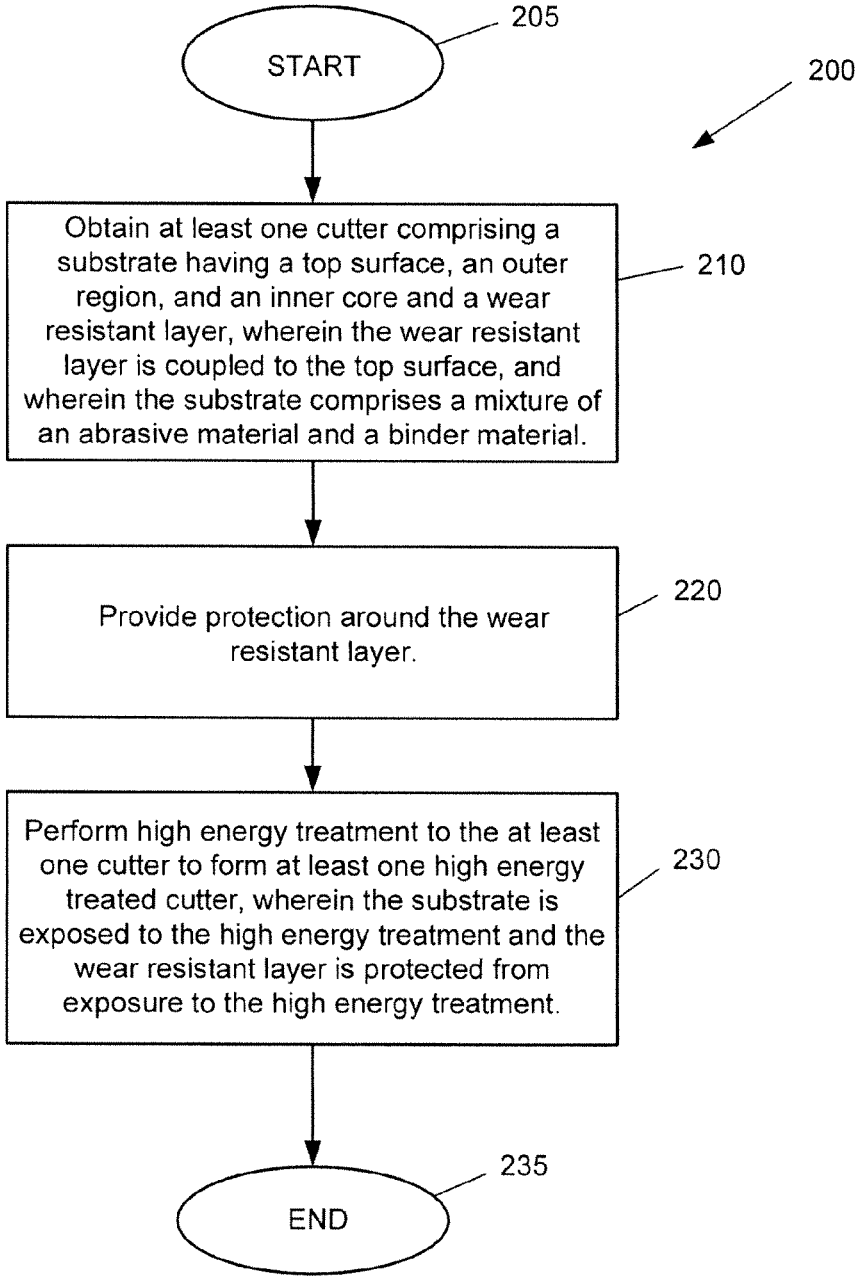
FIG. 2 shows a flowchart illustrating a method for performing high energy treatment on at least one cutter having a substrate and a wear resistant layer in accordance with an exemplary embodiment.

FIG. 2 shows a flowchart illustrating a method 200 for performing high energy treatment on at least one cutter having a substrate and a wear resistant layer in accordance with an exemplary embodiment. The method 200 starts at step 205. Following step 205, at least one cutter comprising a substrate having a top surface, an outer region, and an inner core and a wear resistant layer coupled to the top surface is obtained at step 210. The substrate comprises a mixture of a metallic material and a binder material. After step 210, protection is provided around the wear resistant layer at step 220. After step 220, a high energy treatment is applied to the at least one cutter to form at least one high energy treated cutter at step 230, wherein the substrate is exposed to the high energy treatment and the wear resistant layer is protected from exposure to the high energy treatment. After step 230, the method ends at step 235.

Although the method 200 has been illustrated in certain steps, some of the steps may be performed in a different order without departing from the scope and spirit of the exemplary embodiment. Additionally, some steps may be combined into a single step or divided into multiple steps without departing from the scope and spirit of the exemplary embodiment.

Figure 3A:
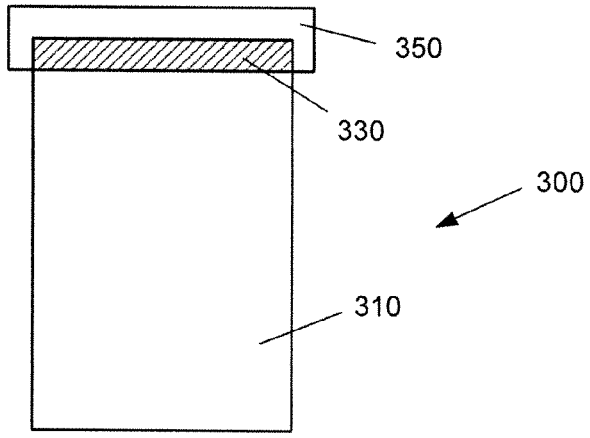
FIG. 3A shows a side cross-sectional view of a cutter having a substrate and a wear resistant layer coupled to a first protective cover that may be used during a high energy treatment process in accordance with an exemplary embodiment.
Figure 3B:
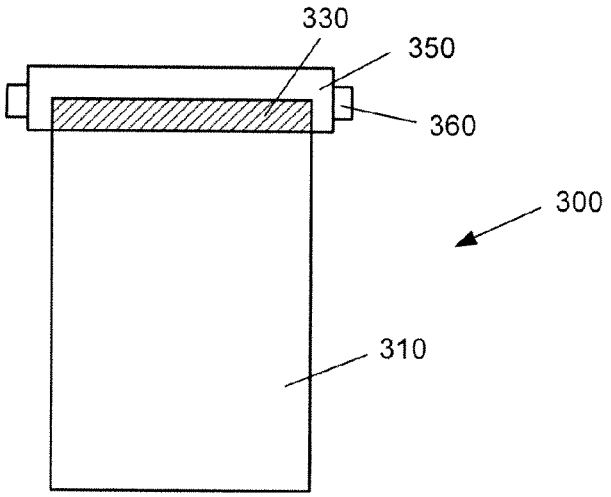
FIG. 3B shows a side cross-sectional view of a cutter having a substrate and a wear resistant layer coupled to a first protective cover and a clamp that may be used during a high energy treatment process in accordance with an exemplary embodiment.
Figure 3C:
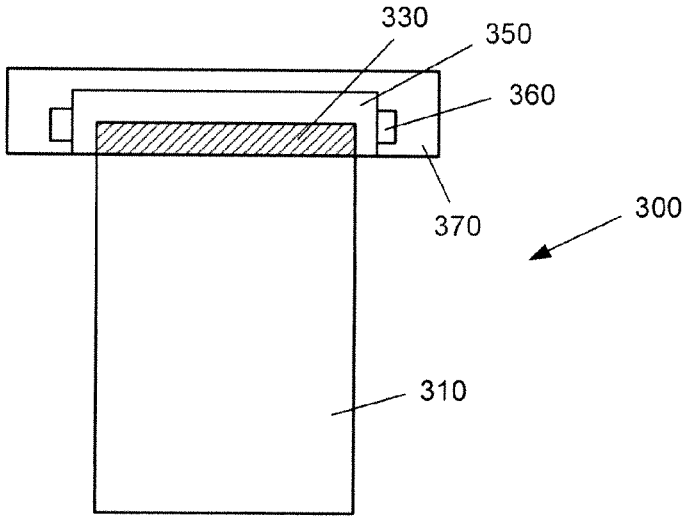
FIG. 3C shows a side cross-sectional view of a cutter having a substrate and a wear resistant layer coupled to a first protective cover, a clamp, and a second protective cover that may be used during a high energy treatment process in accordance with an exemplary embodiment.
Figure 4:
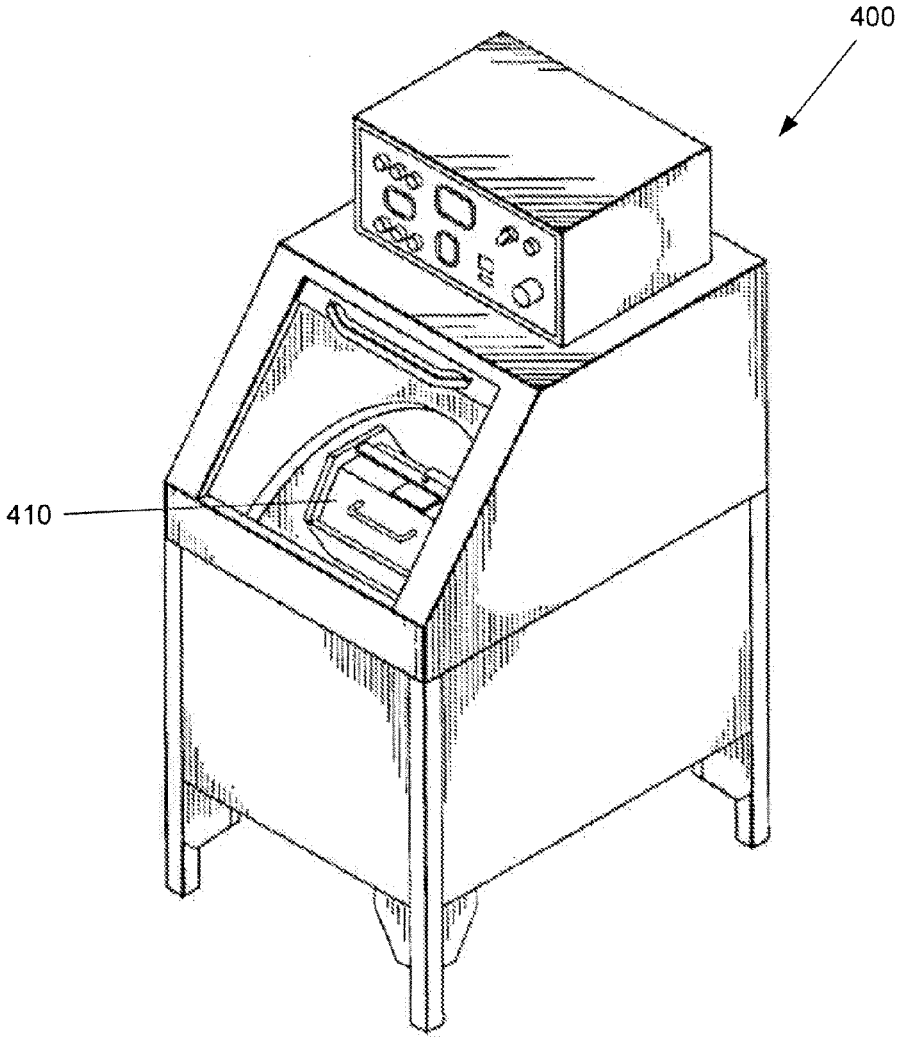
FIG. 4 shows an isometric view of a cascading machine used in a high energy treatment process in accordance with an exemplary embodiment.

Method 200 may be performed according to at least two embodiments. The first embodiment is a cascading high energy treatment embodiment. FIGS. 2-4 are referred to when describing the cascading high energy treatment embodiment. The second embodiment is a spray high energy treatment embodiment. FIGS. 2, 5-7 are referred to when describing the spray high energy treatment embodiment.

With reference to the cascading high energy treatment embodiment, FIG. 2 shows a flowchart illustrating a method for performing high energy treatment on at least one cutter having a substrate and a wear resistant layer in accordance with an exemplary embodiment. As previously mentioned, at least one cutter comprising a substrate having a top surface, an outer region, and an inner core and a wear resistant layer coupled to the top surface is obtained at step 210. As previously mentioned, the wear resistant layer may be fabricated from hard cutting elements including, but not limited to, natural or synthetic diamonds, cubic boron nitride (CBN), and thermally stable polycrystalline diamond (TSP). The substrate is fabricated from a composite material that is typically formed from a mixture of a metallic material, such as tungsten carbide, and a binder material, such as cobalt. At step 210, the substrate is a composite material having the binder material uniformly dispersed throughout the metallic material.

At step 220, protection is provided around the wear resistant layer. FIGS. 3A-3C illustrate exemplary protective devices for protecting the wear resistant layer. Although only some of the exemplary protective devices are illustrated, additional protective devices for protecting the wear resistant layer may be utilized without departing from the scope and spirit of the exemplary embodiment.

FIG. 3A shows a side cross-sectional view of a cutter 300 having a substrate 310 and a wear resistant layer 330 coupled to a first protective cover 350 that may be used during a high energy treatment process in accordance with an exemplary embodiment. The wear resistant layer 330 of cutter 300 has been encapsulated within a first protective cover 350 so that the wear resistant layer 330 remains protected from exposure to impact forces generated during the high energy treatment. In one embodiment, the first protective cover 350 encapsulates only the wear resistant layer 330. In this embodiment, a small portion of the perimeter of the substrate 310 located adjacent to the wear resistance layer 330 may receive minimal high energy treatment because of the difficulty of generating impact forces where the first protective cover 350 meets with the substrate 310. Thus the small portion of the perimeter adjacent to the wear resistance layer 330 remains more cobalt rich and therefore has a greater toughness than if it had been exposed to higher levels of the high energy treatment. In an alternative embodiment, the first protective cover 350 encapsulates the wear resistance layer 330 and also extends along a portion of the outer perimeter of the substrate 310, the portion of the outer perimeter located immediately adjacent to the wear resistance layer 330. The portion of the outer perimeter of the substrate 310 may be greater than zero inches but less than or equal to 25 thousandths of an inch, greater than zero inches but less than or equal to 50 thousandths of an inch, or greater than zero inches but less than or equal to 100 thousandths of an inch. In other embodiments, the portion of the outer perimeter of the substrate 310 may be greater than 100 thousandths of an inch without departing from the scope and spirit of the exemplary embodiment. In this alternative embodiment, the extension of the first protective cover 350 along the portion of the outer perimeter of the substrate 310 allows that portion to be protected from the impact forces generated during the high energy treatment. Thus, the portion of the outer perimeter of the substrate 310 will remain more cobalt rich and therefore have a greater toughness than if it had been exposed to the high energy treatment. The increased toughness adjacent to the wear resistant layer 330 will provide greater support to the wear resistant layer 330, and therefore provide for greater longevity of the cutter 300.

The first protective cover 350 may be made of any material capable of providing protection to the wear resistant layer 330 and still withstand the impact forces generated during a predetermined time period of the high energy treatment. These materials include, but are not limited to, rubber, any type of elastomer, polyurethane, a soft metal, for example copper, inside a steel crimp cap, and epoxy. The first protective cover 350 may be coupled around the wear resistance layer 330 by its own adherence to the wear resistance layer 330 or by using a bonding agent, for example glue, to couple the first protective cover 350 around the wear resistance layer 330. One example of a glue used to couple the first protective cover 350 to the wear resistance layer 330 is Bakerlok®. However, other types of bonding agents may be used without departing from the scope and spirit of the exemplary embodiment.

FIG. 3B shows a side cross-sectional view of a cutter 300 having a substrate 310 and a wear resistant layer 330 coupled to a first protective cover 350 and a clamp 360 that may be used during a high energy treatment process in accordance with an exemplary embodiment. This embodiment is similar to the embodiment described with respect to FIG. 3A, except that a clamp 360 is coupled around the first protective cover 350 to provide secure coupling of the first protective cover 350 to the wear resistance layer 330. The clamp 360 may be a ring or a metal band. One example of the clamp 360 is a worm gear clamp. Although a worm gear clamp has been provided as one example of a clamp, other clamps may be used to secure the first protective cover 350 to the wear resistant layer 330 without departing from the scope and spirit of the exemplary embodiment.

FIG. 3C shows a side cross-sectional view of a cutter 300 having a substrate 310 and a wear resistant layer 330 coupled to a first protective cover 350, a clamp 360, and a second protective cover 370 that may be used during a high energy treatment process in accordance with an exemplary embodiment. This embodiment is similar to the embodiment described with respect to FIG. 3B, except that a second protective cover 370 is coupled around the first protective cover 350 and the clamp 360 to provide secure coupling of the clamp 360 to the first protective cover 350. Since the clamp 360 may have portions of it extending away from the perimeter of the first protective cover 350, the second protective cover 370 will provide for a uniform perimeter around the clamp 360 and hence reduce the chances of the protective device becoming unsecured from the wear resistant layer 330. The second protective cover 370 may be fabricated from the same materials as described for the first protective cover 350. Additionally, the second protective cover 370 may be fabricated to protect only the wear resistant layer 330 or to protect the wear resistant layer 330 and a portion of the outer perimeter of the substrate 310, the portion of the outer perimeter located adjacent to the wear resistance layer 330. The benefits for this configuration has been described with respect to the first protective cover 350.

At step 230, a high energy treatment is applied to the at least one cutter to form at least one high energy treated cutter, wherein the substrate is exposed to the high energy treatment and the wear resistant layer is protected from exposure to the high energy treatment. According to the cascading high energy treatment embodiment, the high energy treatment is performed within a cascading machine 400 as shown in FIG. 4 and described in detail in U.S. Pat. No. 7,258,833, issued to Rainey et al. on Aug. 21, 2007, which has been incorporated by reference herein. FIG. 4 shows an isometric view of the cascading machine 400 used in a high energy treatment process in accordance with an exemplary embodiment.

FIG. 4 shows an isometric view of a cascading machine 400 used in a high energy treatment process in accordance with an exemplary embodiment. Inside cascading machine 400, cutters are repeatedly collided with each other with such force that the surfaces of the substrate of the cutters are plastically deformed, creating residual compressive stresses along the surfaces of the substrate. The wear resistant layer is not exposed to these forces because of the protection provided to the wear resistant layer. This process is accomplished by placing the cutters within at least one rotatable drum 410, placing the at least one rotatable drum 410 within the cascading machine 400, adding a medium into the at least one rotatable drum 410, and rotating the at least one rotatable drum 410 under high-energy conditions. The cutters to be cascaded are loaded into the at least one rotatable drum 410 of a cascading machine 400, wherein each of the at least one rotatable drum 410 is approximately 40% full. In some embodiments, the at least one rotatable drum 410 may be filled to a range between about 30% full to about 50% fill. The medium added to each of the at least one rotatable drum 410 may be water. Optionally, cutting abrasives, such as angular steel or crushed metal, may be mixed with the water and used for polishing the cutters. The at least one rotatable drum 410 is then sealed and rotated under high energy conditions in the cascading machine 400. In an alternative embodiment of the cascading machine 400, the at least one rotatable drum 410 may not be removable from the cascading machine 400.

Although the process has been illustrated in certain steps, some of the steps may be performed in a different order without departing from the scope and spirit of the exemplary embodiment. Additionally, some steps may be combined into a single step or divided into multiple steps without departing from the scope and spirit of the exemplary embodiment.

The compressive stresses that result from this process increase the toughness and hardness of the cutters by increasing the threshold level of stress necessary to fracture or deform the substrates. This higher threshold prevents or reduces the likelihood of chipping, cracking, and/or fracture of the substrates. Moreover, the increased surface hardness also increases the wear resistance of the substrates.

Under the high-energy conditions in particular embodiments, cascading machine 400 may be operated at a speed of approximately 100 to greater than 300 RPM. The exact speed within this range may be chosen according to the mass of the individual cutters being cascaded such that the kinetic energy of the cutters within the at least one rotatable drum 410 is maximized without damaging the cutters. Cutters having a smaller mass are cascaded at higher speeds, while cutters having a larger mass are cascaded at lower speeds. With this in mind, the optimal time and optimal speed for the high-energy process will vary depending on the material grade, size, density, geometry, and desired finish of the component being cascaded.

By cascading cutters, having a substrate and a wear resistant layer coupled to the top surface of the substrate, in a high-energy cascading machine, such as cascading machine 400, particular embodiments offer the ability to increase the toughness, or resistance to fracture, of the substrate. This is due to the fact that the cascading motion of the cutters inside the at least one rotatable drum 410 and the high rotational speeds generate numerous forceful collisions between the cutters within the barrels. These forceful collisions plastically deform the binder near the surfaces of the substrate, inducing residual compressive stresses along the surfaces of the substrate. These residual compressive stresses along the surface of each substrate increase the threshold stress required to fracture the substrate, increasing the substrate's toughness. The residual compressive stresses that result from the high-energy cascading also serve to increase the surface hardness, or resistance to deformation, of the substrate for a similar reason. Additionally, the cascading process actually induces an increasing hardness profile in the substrate, meaning the hardness of the substrate is higher at the perimeter of the substrate than at the center of the substrate.

Additionally, in some embodiments of the cascading high energy treatment, the latent and the sub-surface defects that were previously difficult or impossible to detect using typical visual inspection techniques can now be identified. Examples of these defects include sub-surface voids and surface cracks that were difficult to detect prior to cascading. By subjecting the substrate to the high energy treatment, these defects are magnified such that they can be identified prior to using the cutters in their intended applications, saving both time and money spent replacing the cutters at a later time.

With reference to the spray high energy treatment embodiment, FIG. 2 shows a flowchart illustrating a method for performing high energy treatment on at least one cutter having a substrate and a wear resistant layer in accordance with an exemplary embodiment. As previously mentioned, at least one cutter comprising a substrate having a top surface, an outer region, and an inner core and a wear resistant layer coupled to the top surface is obtained at step 210. As previously mentioned, the wear resistant layer may be fabricated from hard cutting elements including, but not limited to, natural or synthetic diamonds, cubic boron nitride (CBN), and thermally stable polycrystalline diamond (TSP). The substrate is fabricated from a composite material that is typically formed from a mixture of a metallic material, such as tungsten carbide, and a binder material, such as cobalt. At step 210, the substrate is a composite material having the binder material uniformly dispersed throughout the abrasive material.

Figure 5A:
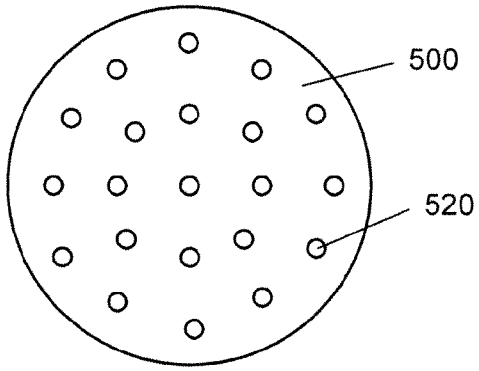
FIG. 5A shows a top view of a tray table in accordance with an exemplary embodiment.
Figure 5B:
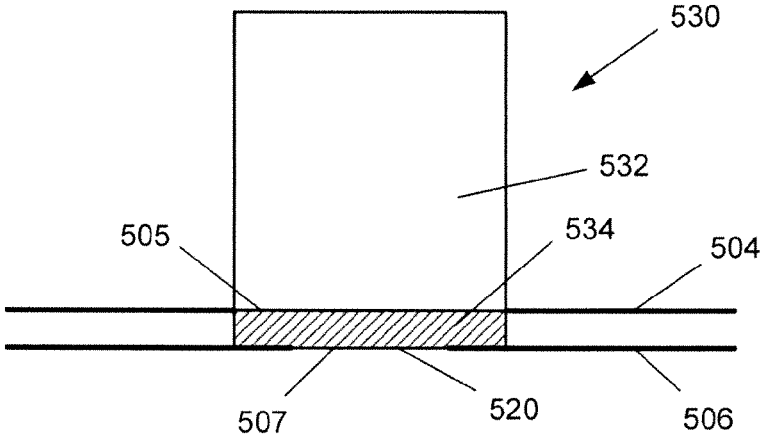
FIG. 5B shows a side cross-sectional view of a cutter having a substrate and a wear resistant layer positioned in a recess, shown in FIG. 5A, in accordance with an exemplary embodiment.
Figure 5C:
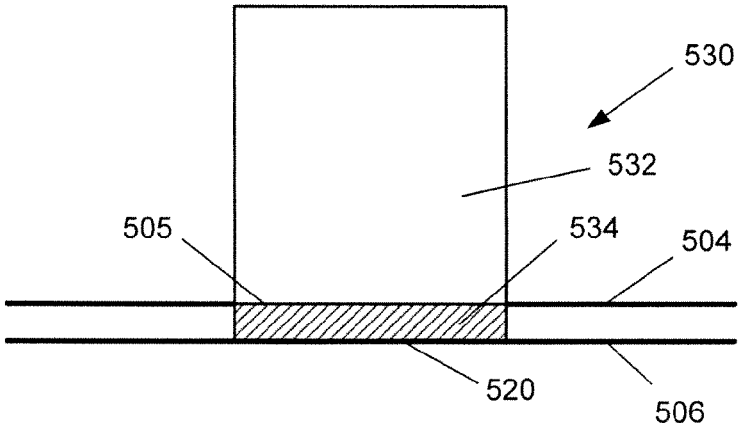
FIG. 5C shows a side cross-sectional view of a cutter having a substrate and a wear resistant layer positioned in a recess, shown in FIG. 5A, in accordance with another exemplary embodiment.

At step 220, protection is provided around the wear resistant layer. FIGS. 5A-5C illustrate an exemplary protective device for protecting the wear resistant layer 534, wherein the exemplary protective device is in the form of a tray table 500. Although a tray table 500 is illustrated, alternative protective devices for protecting the wear resistant layer 534 may be utilized without departing from the scope and spirit of the exemplary embodiment.

FIG. 5A shows a top view of a tray table 500 in accordance with an exemplary embodiment. FIG. 5B shows a side cross-sectional view of a cutter 530 having a substrate 532 and a wear resistant layer 534 positioned in a recess 520, shown in FIG. 5A, in accordance with an exemplary embodiment. FIG. 5C shows a side cross-sectional view of a cutter 530 having a substrate 532 and a wear resistant layer 534 positioned in a recess 520, shown in FIG. 5A, in accordance with another exemplary embodiment.

Referring to FIGS. 5A-5C, the tray table 500 is one example of a protective device for protecting the wear resistant layer 534 of the cutter 530 while the substrate 532 undergoes a high energy treatment. The tray table 500 comprises at least one recess 520, wherein the at least one recess 520 has a depth equal to the thickness of the wear resistant layer 534. For example, if the thickness of the wear resistant layer 534 is one hundred thousandths of an inch, then the depth of the at least one recess 520 is also one hundred thousandths of an inch. This configuration allows the wear resistant layer 534 to be protected during the high energy treatment once the wear resistant layer 534 of the cutter 530 has been positioned within the at least one recess 520, while the entire substrate 532 would be exposed to the high energy treatment.

Although this embodiment shows that the at least one recess 520 has a depth equal to the thickness of the wear resistant layer 534, the depth of the at least one recess 520 may be slightly larger than the thickness of the wear resistant layer 534. For example, the depth of the at least one recess 520 may be up to 25 thousandths of an inch greater than the thickness of the wear resistant layer 534. In another example, the depth of the at least one recess 520 may be up to 50 thousandths of an inch greater than the thickness of the wear resistant layer 534. Additionally, according to another example, the depth of the at least one recess 520 may be up to 100 thousandths of an inch greater than the thickness of the wear resistant layer 534. The benefits of having the depth of the at least one recess 520 to be slightly greater than the thickness of the wear resistant layer 534 has been described above with respect to the first protective cover 350 of the cascading high energy treatment embodiment.

The at least one recess 520 is shown to have a circular shape. Although this embodiment shows the at least one recess 520 being a circular shape, the at least one recess 520 may be any geometric shape, including but not limited to square, oval, and rectangular, so long as the at least one recess 520 has the same shape as the wear resistant layer 534 without departing from the scope and spirit of the exemplary embodiment. Additionally, the size of the at least one recess 520 is slightly larger than the size of the wear resistant layer 534 provided that a tight tolerance exists between the wear resistant layer 534 and the at least one recess 520.

As seen in FIG. 5A, the at least one recess 520 may form a pattern in the tray table 500. Although the at least one recess 520 forms a pattern in the tray table 500 according to this embodiment, other embodiments may have the at least one recess 520 randomly scattered throughout the tray table 500.

Additionally, although the tray table 500 has been illustrated as being circular in shape, the tray table 500 may be shaped into any other geometric shape without departing from the scope and spirit of the exemplary embodiment. The tray table 500 may also be convexedly shaped, wherein the center of the tray table 500 is raised above the perimeter of the tray table and the surface gradually slopes downward from the center of the tray table 500 to the perimeter of the tray table 500. This shape for the tray table 500 may facilitate the recycling or removal of a high energy media stream, which will be discussed in further detail below. Alternatively, the tray table 500 may be substantially planar without departing from the scope and spirit of the exemplary embodiment.

Referring now to FIG. 5B, one exemplary configuration of the at least one recess 520 in the tray table 500 is illustrated. According to this configuration, the at least one recess 520 is surrounded by a portion of the tray table 500, wherein the tray table 500 comprises an upper surface 504 and a bottom surface 506. To form the at least one recess 520, the upper surface 504 comprises a first opening 505 for allowing passage of the wear resistant layer 534 and the bottom surface 506 comprises a second opening 507 for providing support to the wear resistant layer 534 so that the cutter 530 does not pass through the second opening 507. The first opening 505 is slightly larger than the diameter or perimeter of the wear resistant layer 534. This first opening 505 is dimensioned such that a tight tolerance is created between the at least one recess 520 and the wear resistant layer 534. Additionally, the second opening 507 is smaller than the diameter or perimeter of the wear resistant layer 534. Thus, the first opening 505 is larger than the second opening 507.

In this embodiment, the cutter 530 may be secured to the tray table 500 by at least one of the following methods. The wear resistant layer 534 may be bonded using a bonding agent within the at least one recess 520. As previously mentioned, one example of a bonding agent is glue, which may be Bakerlok®, for example. Alternatively, the wear resistant layer 534 may be secured to the tray table 500 by applying a weight to the substrate 532 when the cutter 530 has been placed within the at least one recess 520. Alternatively, the wear resistant layer 534 may be secured to the tray table 500 by applying a pulling force to the bottom of the wear resistant layer 534 when the cutter 530 has been placed within the at least one recess 520. One example of applying a pulling force is to apply a vacuum to the bottom side of the tray table 500. Although three exemplary methods have been illustrated for securing the wear resistant layer 534 to the at least one recess 520, these methods may be used alone or in combination with one another without departing from the scope and spirit of the exemplary embodiment. Additionally, although three exemplary methods have been illustrated for securing the wear resistant layer 534 to the at least one recess 520, alternative methods for securing the wear resistant layer 534 to the at least one recess 520 may be used without departing from the scope and spirit of the exemplary embodiment.

Referring now to FIG. 5C, another exemplary configuration of the at least one recess 520 in the tray table 500 is illustrated. According to this configuration, the at least one recess 520 is surrounded by a portion of the tray table 500, wherein the tray table 500 comprises an upper surface 504 and a bottom surface 506. To form the at least one recess 520, the upper surface 504 comprises a first opening 505 for allowing passage of the wear resistant layer 534 and the bottom surface 506 is a continuous surface for providing support to the wear resistant layer 534 so that the cutter 530 does not pass through the bottom surface 506. The first opening 505 is slightly larger than the diameter or perimeter of the wear resistant layer 534. This first opening 505 is dimensioned such that a tight tolerance is created between the at least one recess 520 and the wear resistant layer 534.

In this embodiment, the cutter 530 may be secured to the tray table 500 by at least one of the following methods. The wear resistant layer 534 may be bonded using a bonding agent within the at least one recess 520. As previously mentioned, one example of a bonding agent is glue, which may be Bakerlok®, for example. Alternatively, the wear resistant layer 534 may be secured to the tray table 500 by applying a weight to the substrate 532 when the cutter 530 has been placed within the at least one recess 520. Although two exemplary methods have been illustrated for securing the wear resistant layer 534 to the at least one recess 520, these methods may be used alone or in combination with one another without departing from the scope and spirit of the exemplary embodiment. Additionally, although two exemplary methods have been illustrated for securing the wear resistant layer 534 to the at least one recess 520, alternative methods for securing the wear resistant layer 534 to the at least one recess 520 may be used without departing from the scope and spirit of the exemplary embodiment.

Figure 6:
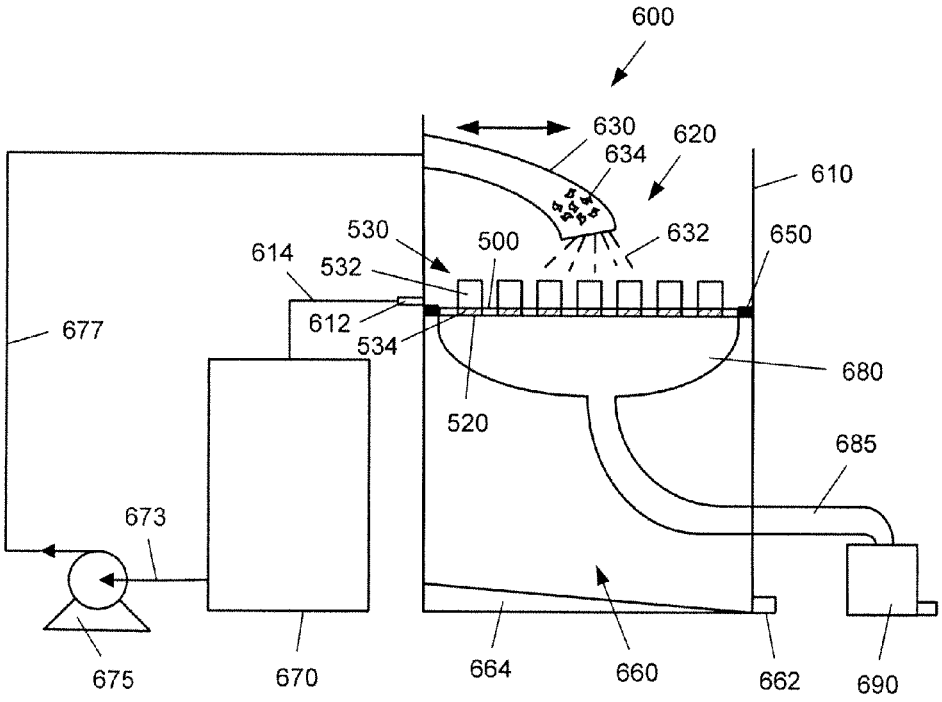
FIG. 6 shows a diagram of a spray high energy treatment system in accordance with an exemplary embodiment.

At step 230, a high energy treatment is applied to the at least one cutter to form at least one high energy treated cutter, wherein the substrate is exposed to the high energy treatment and the wear resistant layer is protected from exposure to the high energy treatment. According to the spray high energy treatment embodiment, the high energy treatment is performed within a cabinet 610 as shown in FIG. 6. FIG. 6 shows a diagram of a spray high energy treatment system 600 in accordance with an exemplary embodiment.

In one embodiment, the spray high energy treatment system 600 comprises the cabinet 610 having a high energy treatment region 620 and a drip region 660, a slurry reservoir tank 670, and a slurry reservoir tank pump 675. The slurry reservoir tank 670 and the slurry reservoir tank pump 675 are optional and are used only when desiring recycling of a high energy media stream 632.

The cabinet 610 is configured to have a right circular cylindrical shape that is fabricated from a metal, metal alloy, or any other material capable of withstanding the operating conditions taking place within the cabinet 610. Although the cabinet 610 is configured to have a right circular cylindrical shape according to an exemplary embodiment, other embodiments may have the cabinet 610 configured into an alternative geometric shape, including, but not limited to, a rectangular shape or square shape, without departing from the scope and spirit of the exemplary embodiment. The cabinet 610 may be enclosed at the top or open at the top as shown in FIG. 6.

The high energy treatment region 620 comprises at least one spray nozzle 630, and a tray table 500. In certain other embodiments, the high energy treatment region 620 may also comprise a seal 650. According to this embodiment, the at least one spray nozzle 630 is gooseneck-shaped and is fabricated from a metal, metal alloy, or any other material capable of withstanding the operating conditions taking place within the at least one spray nozzle 630. The at least one spray nozzle 630 is designed to have a plurality of spray holes (not shown) spaced and sized to allow for a uniform spraying of a high energy media stream 632 onto at least a portion of the tray table 500. In one embodiment, there is at least one spray nozzle 630 that is movable with no stationary spray nozzles. The at least one moveable spray nozzle 630 may be movable in a longitudinal horizontal direction, a latitudinal horizontal direction, a vertical direction, or a combination of any one of these directions, either one direction at a time or multiple directions simultaneously. In accordance with another embodiment, there may be at least one spray nozzle 630 that is movable and at least one spray nozzle 630 that is stationary. In accordance with another embodiment, there may be at least one spray nozzle 630 that is stationary and no moveable spray nozzles. The at least one spray nozzle 630 may be positioned so that the high energy media stream 632 is directed at an angle towards the tray table 500. This configuration allows the high energy media stream 632 to provide high energy treatment to a greater area of the substrate 532 of the cutters 530 that have been positioned within the at least one recess 520 of the tray table 500, especially providing the ability of treating the portion of the substrate immediately adjacent to the wear resistant layer 534. In some embodiments, the movable spray nozzle may be designed to have movement so that it provides coverage to the entire surface of the tray table 500 in the longitudinal horizontal direction, the latitudinal horizontal direction, or in both of these directions.

The high energy media stream 632 comprises a plurality of shot material 634. The shot material 634 may include, but is not limited to, crushed tungsten carbide, steel, metallic blast media, ceramic, or any combination of these materials. Other materials capable of providing impact forces on the substrate 532 may also be used as shot material 634 without departing from the scope and spirit of the exemplary embodiment. The shot material 634, as seen in FIG. 6, is angular so that it may apply some impact forces, or treatment, on the substrate 532 in an area located immediately adjacent the wear resistant layer 534. However, the shot material 634 may be spherical in shape without departing from the scope and spirit of the exemplary embodiment. In some embodiments, the size and shape of the shot material 634 may vary within the high energy media stream 632. Additionally, the high energy media stream 632 may include a liquid slurry. However, a liquid slurry in the high energy media stream 632 is optional.

The tray table 500 and the seal 650 separate the high energy treatment region 620 and the drip region 660 from one another. The tray table 500 has been described above in detail and is similar to the tray table used herein. The tray table 500 is rotatable, either in a clockwise direction or in a counter-clockwise direction, in some embodiments, while the tray table 500 is stationary in other embodiments. Additionally, the tray table 500, whether rotatable or stationary, may vibrate so that movement of the shot material 634 across the tray table 500 may be facilitated. In some embodiments, the rotation of the tray table 500 may be performed manually, for example, a handle to rotate the tray table 500, or performed automatically. According to embodiments using the rotatable tray table 500, a plurality of spray nozzles 630 may be used, wherein some or all of the spray nozzles are stationary. Alternatively, some or all of the spray nozzles 630 may be movable in these embodiments. Additionally, there may be only one spray nozzle 630 that is movable such that it is capable of providing all exposed substrates 532 with uniform coverage to the high energy media stream 632. According to the embodiments using the stationary tray table 500, a plurality of spray nozzles 630 may be used, wherein some or all of the spray nozzles are stationary. Alternatively, some or all of the spray nozzles 630 may be movable in these embodiments. Moreover, there may be only one spray nozzle 630 that is movable such that it is capable of providing all exposed substrates 532 with uniform coverage to the high energy media stream 632.

Most importantly, the design and characteristics of the interaction between the at least one spray nozzle 630 and the tray table 500 should allow the exposed substrates 532 to have uniform exposure to the high energy media stream 632. Thus, in certain embodiments, one substrate 532 should not be exposed to excessive amounts of the high energy media stream 632, while another substrate 532 is not exposed to enough amounts of the high energy media stream 632. In some embodiments, each of the substrates 532 should be exposed to uniform exposure to the high energy media stream 632 to within plus or minus five percent exposure. In another embodiment, each of the substrates 532 should be exposed to uniform exposure to the high energy media stream 632 to within plus or minus ten percent exposure. According to one embodiment, the impact forces generated from the high energy media stream 632 is equivalent to the impact forces generated in the cascading high energy treatment embodiment. In another embodiment, the impact forces generated from the high energy media stream 632 is about plus or minus 20% of the impact forces generated in the cascading high energy treatment embodiment.

Figure 7A:
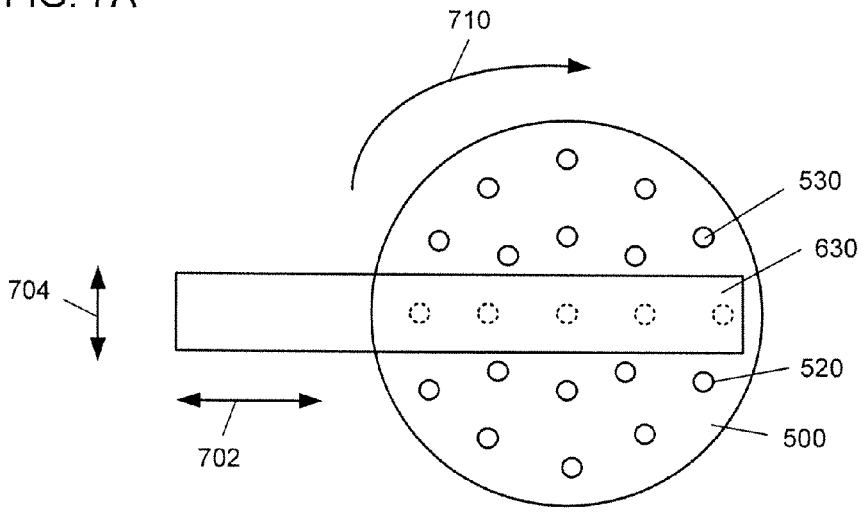
FIG. 7A shows a top view of a tray table and a spray nozzle used in the high energy treatment process in accordance with an exemplary embodiment.
Figure 7B:
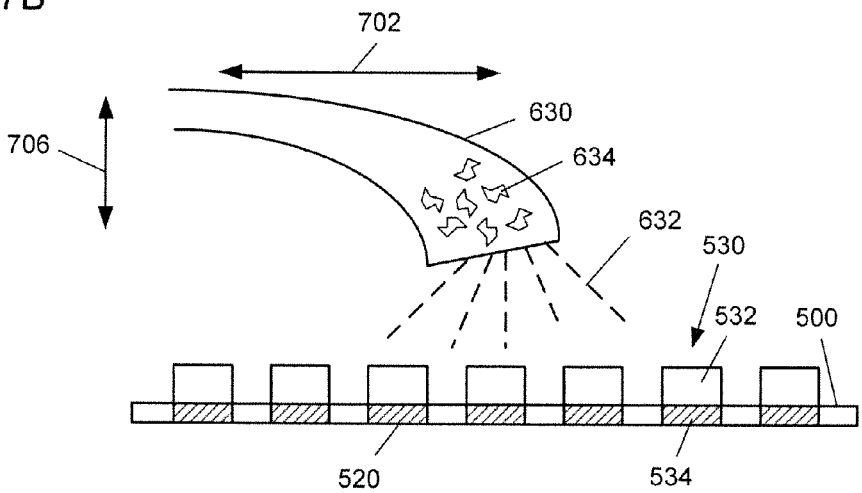
FIG. 7B shows a side view of the tray table and the spray nozzle of FIG. 7A in accordance with an exemplary embodiment.

Although numerous embodiments exist that reflect the interaction between the at least one spray nozzle 630 and the tray table 500, FIG. 7A and FIG. 7B illustrates one embodiment reflecting the interaction between the at least one spray nozzle 630 and the tray table 500. FIG. 7A shows a top view of a tray table 500 and a spray nozzle 630 used in the high energy treatment process in accordance with an exemplary embodiment. FIG. 7B shows a side view of the tray table 500 and the spray nozzle 630 of FIG. 7A in accordance with an exemplary embodiment. According to these figures, one spray nozzle 630 is positioned above the tray table 500. The tray table 500 comprises a plurality of recesses 520 having the wear resistant layer 534 of a plurality of cutters 530 placed within the plurality of recesses 520. The tray table is shown to be rotatable in a clockwise direction 710. The spray nozzle 630 is shown to be able to move in a longitudinally horizontal direction 702, a latitudinal horizontal direction 704, and a vertical direction 706 such that the entire tray table 500 may be uniformly exposed to the high energy media stream 632. The high energy media stream 632 comprises a shot material 634, which is shown to be angular in this embodiment. The pattern of the plurality of recesses 520 are such that the shot material 634 may provide some treatment to all of the exposed area of the substrates 532.

Referring back to FIG. 6, the seal 650 may be positioned between the tray table 500 and the cabinet 610 in certain embodiments. The seal 650 allows for a minimal portion of the high energy media stream 632 to enter into the drip region 660. The seal 650 allows for a substantial portion of the high energy media stream 632 to collect at the top of the tray table 500 so that it may be collected and recycled back to the at least one spray nozzle 630, according to certain embodiments. The seal 650 may be fabricated from any material known to those of ordinary skill in the art without departing from the scope and spirit of the exemplary embodiment.

The drip region 660 is provided to collect the minimal portion of the high energy media stream 632 that may drip from the high energy treatment region 620. A minimal portion of the high media stream 632 is collected in the drip region 660 and is drained out of the cabinet 610 at some later desired time through one or more drain nozzles 662. Additionally, the drip region 660 may further comprise a drip slope 664 positioned at the bottom of the drip region 660. The drip slope 664 facilitates drainage of the drip region 660 by allowing the minimal portion of the high media stream 632 to collect adjacent to the one or more drain nozzles 662.

In certain embodiments, the substantial portion of the high energy media stream 632 is recycled back to the at least one spray nozzle 630 via the slurry reservoir tank 670 and the slurry reservoir tank pump 675. The high energy media stream 632 exits the cabinet 610 through cabinet discharge nozzle 612 and flows to the slurry reservoir tank 670 via a cabinet discharge line 614. The high energy media stream 632 collects within the slurry reservoir tank 670 and then flows to the slurry reservoir tank pump 675 via a slurry reservoir tank pump suction line 673. The slurry reservoir tank pump 675 then increases the pressure of the high energy media stream 632 and delivers the high energy media stream 632 to the at least one spray nozzle 630 via a slurry reservoir tank pump discharge line 677. Each of the cabinet discharge line 614, the slurry reservoir tank pump suction line 673, and the slurry reservoir tank pump discharge line 677 may be fabricated from a flexible hose, including but not limited to rubber, or from metal or metal alloy piping.

As previously mentioned, the cutters 530 may be secured within the at least one recess 520 via a weight, bonding agent, or a pulling force. FIG. 6 illustrates an exemplary embodiment depicting a pulling force in the form of a vacuum. According to this embodiment, the drip region 660 may further comprise a vacuum region 680. The vacuum region is isolated from a portion of the drip region 660 and is coupled to the bottom side of the tray table 500. This embodiment is used when the tray table 500 has a bottom surface comprising a second opening so that the vacuum may secure the cutters 530 to the at least one recess 520 of the tray table 500. The vacuum region 680 is coupled to a vacuum generator 690 via a vacuum hose 685. The vacuum generator 690 may be designed to accommodate any high energy media stream 632 that may drip into the vacuum region 680 through the second opening within the at least one recess 520. In some embodiments, the vacuum generator 690 may recycle the high energy media stream 632 back to the slurry reservoir tank 670.

Although the invention has been described with reference to specific embodiments, these descriptions are not meant to be construed in a limiting sense. Various modifications of the disclosed embodiments, as well as alternative embodiments of the invention will become apparent to persons skilled in the art upon reference to the description of the invention. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims. It is therefore, contemplated that the claims will cover any such modifications or embodiments that fall within the scope of the invention.

What is claimed is:

1. A high energy treated cutter, comprising:

a substrate having a top surface, an outer region, an inner core being at least partially surrounded by the outer region, and an interface disposed between the inner core and the outer region, wherein the substrate comprises a mixture of a metallic material and a binder material, at least a portion of the outer region having a lower concentration of the binder material than the inner core, the interface having a highest concentration of binder material than the inner core and the outer region; and a wear resistant layer coupled to the top surface of the substrate, wherein the substrate has been exposed to a high energy treatment, and wherein the wear resistant layer has been protected from exposure to the high energy treatment using a protective cover, and wherein the interface extends to the outer perimeter of the substrate at a distance away from the top surface.

2. The high energy treated cutter of claim 1, wherein the metallic material comprises tungsten carbide.

3. The high energy treated cutter of claim 1, wherein the binder material comprises cobalt.

4. The high energy treated cutter of claim 1, wherein the wear resistant layer is fabricated from at least one material selected from the group consisting of polycrystalline diamond, cubic boron nitride, and thermally stable polycrystalline diamond.

5. The high energy treated cutter of claim 1, wherein the outer region has a greater hardness than the inner core.

6. The high energy treated cutter of claim 1, wherein the inner core has a greater toughness than the outer region.

7. The high energy treated cutter of claim 1, wherein the high energy treatment comprises generating impact forces on the surface of the outer region of the substrate.

8. The high energy treated cutter of claim 1, wherein the distance is greater than zero inches and less than or equal to twenty-five thousandths of an inch.

9. The high energy treated cutter of claim 1 wherein the distance is greater than zero inches and less than or equal to fifty thousandths of an inch.

10. The high energy treated cutter of claim 1, wherein the distance is greater than zero inches and less than or equal to one hundred thousandths of an inch.

11. A high energy treated cutter, comprising:

a substrate having a top surface, an outer region, an inner core being at least partially surrounded by the outer region, and an interface disposed between the inner core and the outer region, wherein the substrate comprises a mixture of a tungsten carbide material and a cobalt material, at least a portion of the outer region having a lower concentration of the cobalt material than the inner core, the interface having a highest concentration of cobalt material than the inner core and the outer region; and a wear resistant layer coupled to the top surface of the substrate, the wear resistant layer comprising a polycrystalline diamond, wherein the substrate has been exposed to a high energy treatment, and wherein the wear resistant layer has been protected from exposure to the high energy treatment using a protective cover, and wherein the interface extends to the outer perimeter of the substrate at a distance away from the top surface.

12. The high energy treated cutter of claim 11, wherein the outer region has a greater hardness than the inner core.

13. The high energy treated cutter of claim 11, wherein the inner core has a greater toughness than the outer region.

14. The high energy treated cutter of claim 11, wherein the distance is greater than zero inches and less than or equal to twenty-five thousandths of an inch.

15. The high energy treated cutter of claim 11, wherein the distance is greater than zero inches and less than or equal to fifty thousandths of an inch.

16. The high energy treated cutter of claim 11, wherein the distance is greater than zero inches and less than or equal to one hundred thousandths of an inch.

* * * * *